United States Patent [19]

Polasek

[11] 4,362,256

[45] Dec. 7, 1982

[54] BEVERAGE DISPENSER

[76] Inventor: Randolph J. Polasek, 8900 Gittins, Union Lake, Mich. 48085

[21] Appl. No.: 115,344

[22] Filed: Jan. 25, 1980

[51] Int. Cl.[3] ..... B67D 5/54

[52] U.S. Cl. ..... 222/383; 222/541

[58] Field of Search ..... 222/383, 385, 382, 209, 222/399, 633, 85, 86, 91, 541, 82, 83, 83.5

[56] References Cited

U.S. PATENT DOCUMENTS

| | | | |
|---|---|---|---|
| 247,784 | 10/1881 | Schmidt et al. . | |
| 466,336 | 1/1892 | Fraklin | 222/209 X |
| 498,357 | 5/1893 | Mehring . | |
| 1,956,724 | 5/1934 | Lueck . | |
| 2,028,098 | 1/1936 | Zafuta . | |
| 2,032,722 | 3/1936 | Schwab . | |
| 2,326,641 | 8/1943 | Heeter et al. | 222/209 X |
| 2,400,955 | 5/1946 | Samel | 222/82 X |
| 3,193,145 | 7/1955 | Vara, Sr. | 222/82 |
| 3,374,927 | 3/1968 | Schmidt | 222/82 |
| 3,752,362 | 8/1973 | Risener | 222/85 |
| 3,821,964 | 7/1974 | Bacon . | |
| 4,119,244 | 10/1978 | Funke . | |

*Primary Examiner*—Stanley H. Tollberg
*Attorney, Agent, or Firm*—Gifford, VanOphem, Sheridan and Sprinkle

[57] ABSTRACT

A beverage dispenser for interchangeable use with beverage containers adapted to be sealingly connected therewith. By use of the dispenser of the present invention, a quantity of a beverage, whether carbonated or not, may be stored in a refrigerated area after having been opened and tapped with the present dispenser. In this manner, a larger quantity of beverage than is normally obtainable in a bottle or can may be stored at home while requiring only one deposit rather than six, twelve, or eighteen separate deposits for various packs of beverages. The dispenser has a hand air pump or gas cartridge and a beverage tap communicating with the interior of the container so that the pressure of the air above the fluid in the container may be increased at will so as to draw beverage from the beverage line connected to the tap. When the beverage container is emptied, the dispenser is removed for use with another container or may be refilled after cleaning.

6 Claims, 5 Drawing Figures

BEVERAGE DISPENSER

BACKGROUND OF THE INVENTION

I. Field of the Invention

The present invention relates to beverage container dispensers and more particularly to dispensers which are adapted for use with a particular kind of container so as to be removable and reusable with several containers.

II. Description of the Prior Art

Since enactment of "bottle ban" laws in the various states, it has become desirable to both purchasers and sellers of containerized beverages to bottle or can the beverages in larger size containers, thus avoiding additional deposits on a number of small containers. For example, a two liter bottle contains enough soft drink or other beverage to fill a normal "six pack". Yet the deposit on the former is commonly only ten cents, whereas the deposit on the latter is three to six times as much.

Nevertheless, the popularity of the intermediate or large beverage containers has not been that great since, once opened, they are susceptible to losing their carbonation and must generally be consumed in a reasonably short period of time. Thus, it has become desirable to provide a device for use with large containers such that a portion of beverage may be withdrawn periodically from a single container requiring only a single bottle or can deposit. To date, no such device has been provided.

Furthermore, the "tappers" normally associated with barrels or half barrels of beer are unusable with these intermediate size containers since they are often too large and since the containers do not have appropriate connection counterparts.

SUMMARY OF THE INVENTION

The problems of the prior art have been overcome by the present invention wherein a removable and reusable tapper is provided for use with containers adapted to sealingly connect to the tapper.

Two embodiments of the invention are disclosed, but both feature a separate air pump or equivalent means and beverage tap sealingly connected to the beverage container. A gas cartridge is also suitable for use with this invention as an equivalent for the air pump. Although only the air pump is referred to below, the invention is not so limited. The dispenser may be designed so as to cover only a single opening of the beverage container and thereafter seal the container for dispensing beverage from the interior thereof. Alternatively, the air pump and tapper may be inserted in separate openings which are subsequently sealed by tightening pliable gaskets against the opening area and against a rigid plate. A rigid plate is connected to a portion of the air pump and tapper, respectively, and inserted into the interior of the container.

When the dispenser is of the type fitted onto a single large opening of the container, the air pump and tapper may be similarly sealed to openings in the body of the dispenser and the body portion of the dispenser is then sealingly engaged with the container. Alternatively, the tapper and air pump may be permanently fixed in the body portion of the dispenser.

In any case, whether the dispenser is of one or two-piece construction, the dispenser is removable and reusable with another container. Since the containers are of intermediate to large size for beverages such as beer, the deposit on an entire six, twelve, eighteen, or twenty-four pack of containers is avoided and a similar amount of beverage is obtained with the deposit on only a single container. Commonly, the deposit on a large container is not significantly more than the deposit on a very small container.

It is, therefore, an object of the present invention to provide a tapper which is removable and reusable on beverage containers adapted for sealing engagement therewith.

It is also an object of the present invention to provide a dispensing device usable with intermediate size containers so as to avoid the inconvenience of multiple deposits on various smaller containers for use with beverages such as beer and soft drinks.

It is also an object of the present invention to provide a dispenser wherein carbonated beverages will maintain their carbonation over a period of time after the dispenser has been sealingly attached to the container.

It is also an object of the present invention to provide a tapper/dispenser wherein the dispenser is sealingly attached to the container so that an air pump or equivalent means may be used to create pressure in the interior of the container so as to be able to withdraw beverage from the interior of the container by means of the tap/-valve portion of the dispenser.

It is also an object of the present invention to provide a beverage dispenser container which is refillable after cleaning.

These and other objects of the present invention will become apparent when read in light of the following description and in conjunction with the drawing figures.

DESCRIPTION OF THE PREFERRED EMBODIMENT

Figure 1:
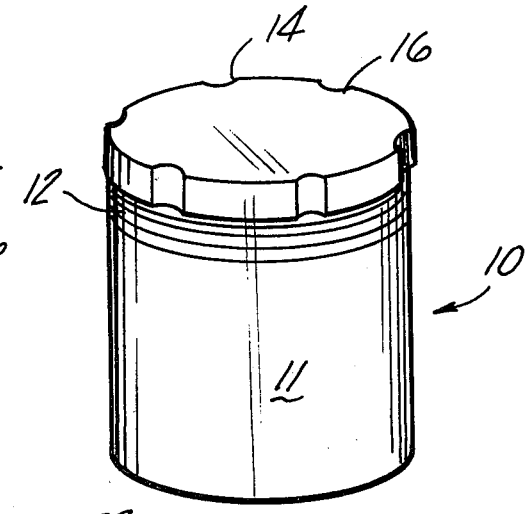
FIG. 1 is a perspective view of a beverage container as purchased.

Referring to FIG. 1, a container 10 is thereshown with screw threaded cap attachment. This container represents a beverage can or similar device, as purchased, with a carbonated beverage or similar potable fluid therein. It should be noted that the invention is not limited to this particular beverage container and may contain such various features as a completely removable pull-top lid. Alternatively, the container may have a screw-on cap as shown but with an inner foil liner, for example, which must be removed before attachment of the dispenser of the present invention.

The dispenser container may be cleaned and refilled with a second potable fluid. The container of this embodiment may be closed and used as a twist-off container.

The beverage container 10 of FIG. 1 has external screw threads 12 and a cap 14 with finger-grip indentations 16.

Figure 2:
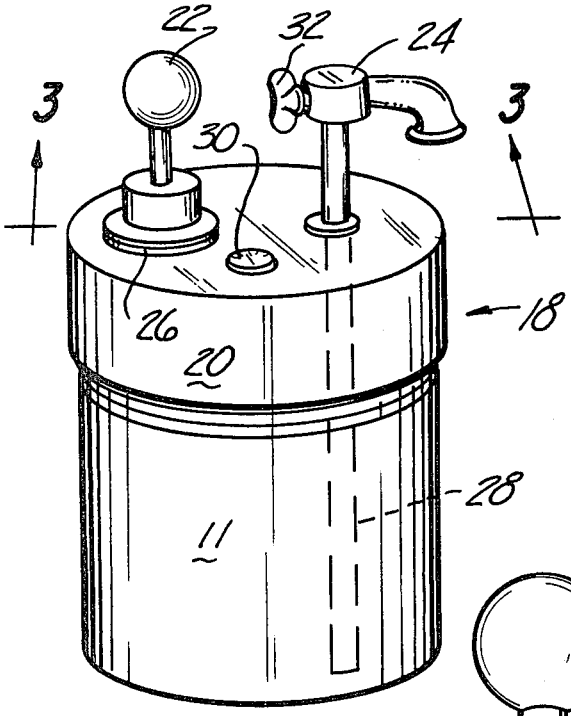
FIG. 2 is a perspective view of the purchased beverage container with a spigot tap of the invention attached thereto.

When the cap 14 has been removed, a preferred embodiment of the dispenser 18 of the present invention may be threadably attached and sealed thereto as now shown in FIG. 2. The body portion 11 of the container is thereby sealed by the removable, reusable dispenser 18 of the invention.

A cup-shaped body portion 20 of the invention is fitted with an air pump 22 and a tap/valve device 24. Although an air pump 22 is discussed herein, a gas cartridge unit may be similarly fitted to the container. The air pump 22 or tap/valve device 24 may be permanently affixed in the body portion 20 of the dispenser 18 as illustrated with the tap/valve device 24. Alternatively, the pump 22 and tap/valve device 24 may be removably affixed to the body portion 20 of the dispenser 18 as illustrated with the air pump 22 which has threads 26 which sealingly close the aperture in the body portion 20 of the dispenser 18. The tap/valve element 24 of the dispenser has an extending draw tube 28 which is designed to protrude to the bottom of the container for which it is designed. In this manner, the opening for drawing of the liquid from the container is below the level of the fluid in the container until it is almost empty.

A pressure gauge 30 is shown attached to the body portion 20 of the dispenser 18 and may be used to insure that sufficient pressure is maintained within the container 10 once the dispenser 18 has been attached thereto. In this manner, sufficient pressure may be kept available on the fluid so as to facilitate drawing of the fluid from the tap/valve 24 by turning the handle 32 of the tap/valve 24. Furthermore, sufficient pressure above the fluid beverage in the container body 11, once sealed by the dispenser 18, helps to maintain the fresh taste and carbonation of the beverage contained therein.

Figure 3:
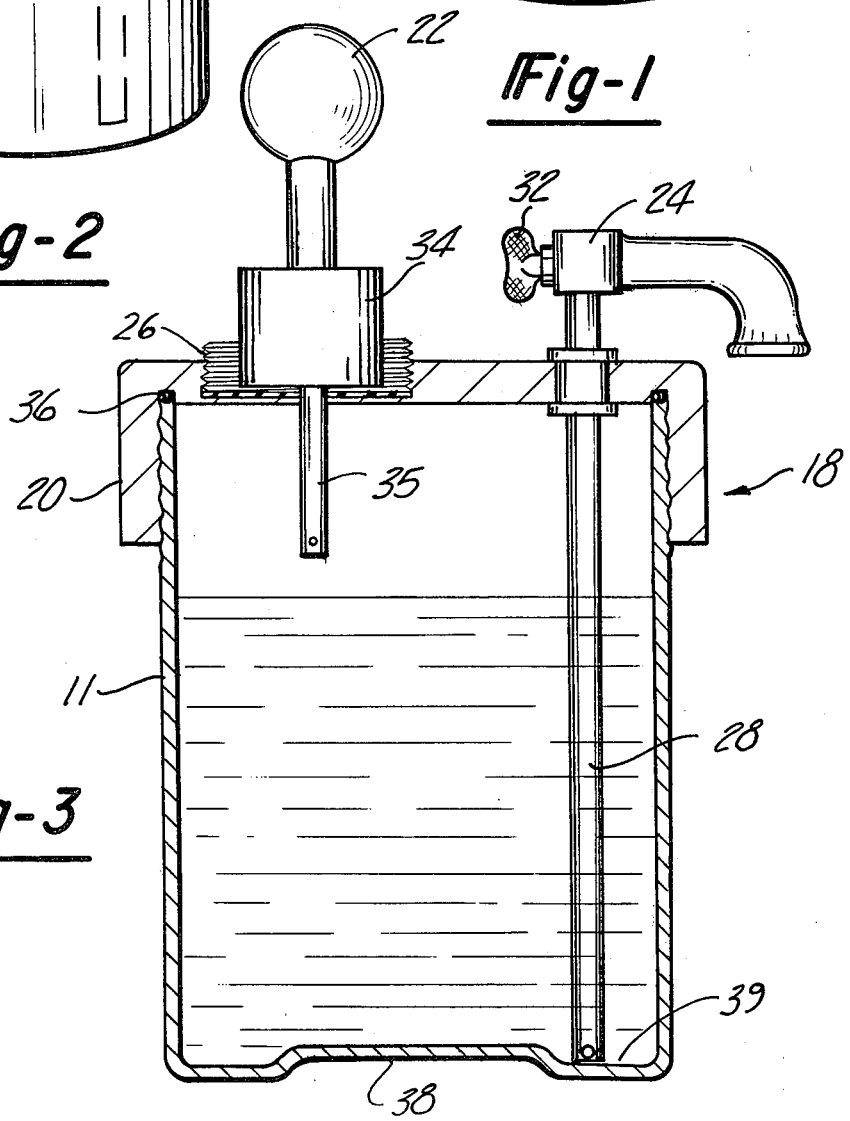
FIG. 3 is a cross-sectional view taken along lines 3—3 of FIG. 2 and showing roll threads and seals at the connection between the spigot tap of FIG. 1 and the purchased beverage container.

Referring now to FIG. 3, the air pump 22, unlike the tap/valve device 24, has only a short air line 35 disposed through the cup-shaped body portion 20 of the dispenser 18 so that the air is pumped into the body portion 11 of the container 10 above the level of the fluid in the container 10. This is an important feature since it is known that pumping the air through the beverage may contaminate the taste or otherwise damage some beverages in the container. The cylinder body and valve device of the air pump are represented schematically as 34 and many forms of such devices are known in the art, any of which will function in a manner to supply an appropriate air pressure inside the container upon operation of the pump 22. For example, a check valve may be used to provide air pressure to the container. Any such equivalent device that will provide a pressure head above the fluid in the container 10 is sufficient to satisfy the requirement of the air pump 22 of the present invention.

A seal 36 is provided embedded in and attached to the cup-shaped body portion 20 of the dispenser but may alternatively be provided on the upper surface of the purchased containers although this may increase the cost of the beverage containers since the seal would not, presumably, be reused. Of course, when the seal 36 of the dispenser 18, as shown, becomes worn, it may be removed and replaced by a like seal to extend the life of the dispenser.

The bottom portion of the container body 11 is recessed at 38 so that when the container is nearly empty, the final ounces of fluid are contained in the deeper portion 39 of the container body 11. Accordingly, the draw tube 28 of the tap/valve 24 is disposed on one side of the container so that the draw tube 28 extends to this deepest portion of the container body 11.

Figure 4:
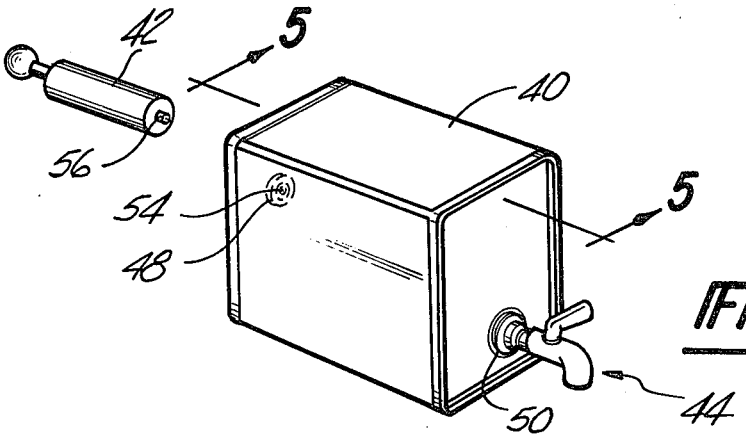
FIG. 4 is a perspective view of an alternate embodiment of the invention wherein the air pump and spigot are attached at separate positions on the purchased container.
Figure 5:
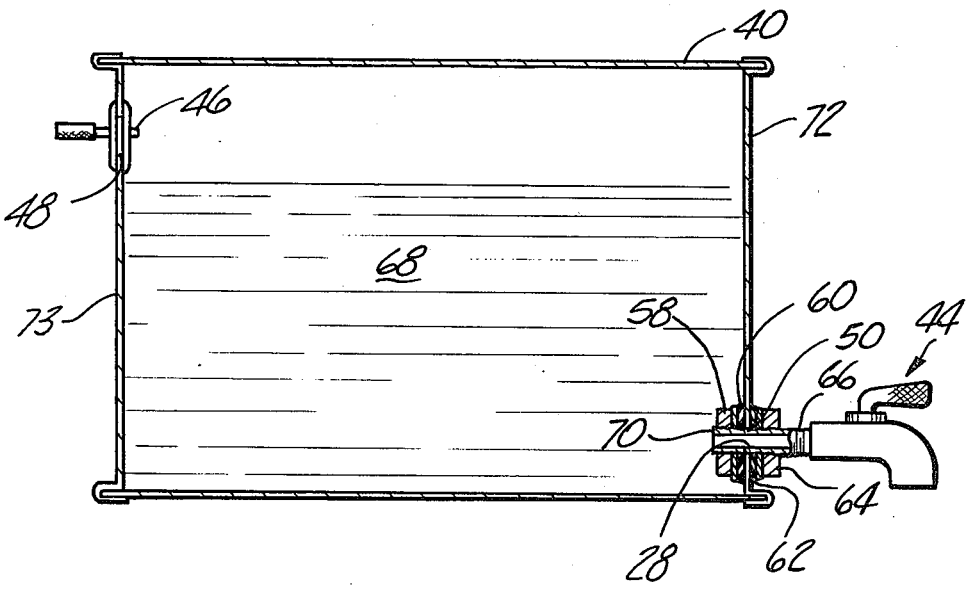
FIG. 5 is a side view of the embodiment shown in FIG. 4 showing the spigot attached to the container.

Referring now to FIGS. 4 and 5, a deposit beverage container 40 such as for beer or a similar beverage is thereshown with two frangible areas 48 and 50 for insertion and attachment of the air pump 42 and the valve spigot 44, respectively.

Again, a gas cartridge unit may be fitted to the structure of the invention in place of the air pump.

In the embodiment of FIGS. 4 and 5, the tap/valve 44 is shown on the lower right-hand side, and the air pump 42 is on the upper left-hand side of the container 40 as seen in FIGS. 4 and 5, such that the draw tube 28 is normally below the fluid level for the container and the air pump inlet 46 is normally above the fluid level to provide air pressure in the container 40. Of course, fluid is drawn from the container 40 and pressure is maintained in the container 10 in a manner similar to that of container 10 in FIGS. 1–3. Again, the air pump 42 is of conventional design as is the air pump of FIGS. 1–3.

The frangible areas 48 and 50 are formed in the deposit beverage container so that they may be easily punctured and the tap 44 or air pump 42 of the invention may be used therewith without the requirement of forming an internal nut or similar threaded device on the inside of the container which would otherwise destroy the economy of forming the deposit beverage containers.

Although the attachment of the air pump 42 may be accomplished by use of a frangible area 48 and sealing means such as is shown at frangible area 50 in FIG. 5, the air pump may be sealingly engaged by a nipple 54 and rubber nozzle 56, as shown in FIG. 4.

Alternatively, the frangible areas 48 and 50 may be formed as a slit or expanded slit, the width of which is about the same as the diameter of a rigid plate 58 of the tap/valve 44 to be inserted in the opening formed by puncturing frangible area 50. However, the flexible gasket or sealing member 60 may be of a somewhat larger diameter than the plate 58 since it may be flexed to be inserted through the slit opening where the frangible area 50 is slit-shaped. In this manner, rigid plate 58, and portion 70 of draw tube 28, and sealing gasket 60 of the tap/valve device 44 may be slipped sideways through the frangible opening 50, straightened, and thereafter tightened with a second flexible sealing gasket or member 62 and an outer rigid plate 64 which is screw threaded on threads 66 of the neck of the tap/-valve element 44.

The container body 40 may be set on end 73, and the tap/valve element 44 thereafter inserted. In this manner, the fluid 68 in the container will be below the opening formed by puncturing the frangible area 50 when the tap/valve element 44 is inserted. Using the slit-type opening of a predetermined width, the stable back 58 is inserted sideways through the opening slit of frangible area 50 while attached to the inlet or end portion 70 of the neck of the tap/valve element 44. Thereafter the flexible gasket 60 is inserted through the hole by flexing it somewhat such that although it has a larger diameter than the width of the slit, it is fitted through the opening. Thereafter, the tap/valve 44 is pushed well into the container and pulled back flush against the wall 72 of the container 40 while the container is sitting upright. The rigid plate 58 thereby forces the flexible gasket 60 against the wall 72 and, although the rigid plate 58 has a slightly smaller diameter than the slit formed by puncturing frangible area 50, the flexible gasket 60 has a larger diameter than the slit and seals the opening at frangible area 50. The seal is secured by tightening the second flexible sealing gasket 62 and outer rigid plate 64 by means of the screw threads. Thereafter, the container 40 is laid again on its side as shown in FIG. 5, the pump 42 is attached, and the pressure above the fluid 68 is increased by injecting some air at 46. The pressure of the fluid bears against wall 72 to increase the sealing engagement of flexible back 60 against wall 72, thereby sealing tap/valve 44 of the invention in the container body 40.

When substantially all of the fluid 68 has been withdrawn from the container 40, the rigid threaded plate 64 is loosened such that the flexible gasket 60 and rigid plate 58 may be removed from the frangible area 50 and the tap/valve element 44 of the invention may be removed and reused in another container.

The advantage of the present invention is that a larger container may be used by consumers for beer, soft drinks, and similar beverages than is presently used without the extreme bulk of an entire keg. With the conventional soft drink or beer can and bottles of the present art, the containers are designed such that the beverage therein is of limited quantity such as twelve, sixteen, or sometimes as large as thirty-two ounces. The beverage must be consumed within a relatively short period of time. Although some of these devices have resealable caps, they have not proven completely effective to maintain the carbonation of large bodies of fluid over a more substantial period of time. Also, it is more troublesome to repeatedly unseal and reseal the container than to simply draw fluid from a tap.

An additional disadvantage of the containers of the prior art is that they require a deposit in many states and consumers will often have a substantial amount of money invested in container deposits at any given time. The present invention is designed to overcome these difficulties of the prior art by providing dispensers of either embodiment for containers as shown in the drawings. In this manner, a container 10 or 40 as shown in FIGS. 1 and 4, respectively, may be designed such that it holds the equivalent of a six-pack, twelve-pack, eighteen-pack, or even a twenty-four-pack container case up to a volume of about 288 ounces. In this manner, only a single deposit is required for any given container under the laws of the states requiring deposits. A deposit of five or ten cents is common for beer and soft drink containers, with ten cents being the standard of the states for aluminum and steel cans. Even the largest of containers seldom has a deposit of more than twenty cents and thus the savings and investment on the deposit for containers would be considerably reduced by a removable, reusable dispenser which conforms to the design of containers normally used for retail sales of such beverages.

Thus, the embodiment of the present invention with a cup-like body portion 20, integral tap/valve 24, and air pump 22 or the embodiment of the present invention with separate air pump 42 and insertable tap/valve 44 would function as reusable, removable elements which could be obtained with one purchase by the consumer and reused with containers such as the cylindrical container 10 shown in FIG. 1 or the rectangular container 40 shown in FIGS. 4 and 5.

Of course, many aspects of the present invention may be varied such as the type of attachment or sealing of the cup-shaped body 20 of the dispenser in the embodiment of FIGS. 1–3 or the nozzle attachment of the air pump of the embodiment of FIGS. 4 and 5. These and other aspects of the present invention may be varied by one skilled in the art without departing from the scope or spirit of the invention.

Therefore, what I claim is:

1. A removable, reusable dispenser for a beverage container having first and second frangible areas, said frangible areas being breakable to form first and second openings in said container, said dispenser comprising:

pressure means having an elongated air inlet adapted to be sealingly connected to said container in said first opening for forcing a gas into said container;

a tap having an elongated fluid inlet, a valve, and a spout, said fluid inlet being adapted to be sealingly connected to said container in said second opening so that said fluid inlet communicates with the interior of said container whereby fluid may be selectively drawn out through said spout by operating said valve;

first means for sealing the air inlet of said pressure means in said first opening;

second means for sealing the fluid inlet of said top tap in said second opening;

wherein said first sealing means comprises a first pliable gasket disposed about said air inlet and insertable through said first opening, a first rigid plate affixed to said air inlet adjacent said first gasket, said first plate being insertable through said first opening, a second pliable gasket disposed about said air inlet and slidable thereon, a second rigid plate slidably disposed on said air inlet adjacent said second gasket, and means for tightening said second plate against said first plate so as to seal said first opening between said first and second gaskets; and wherein said first opening is slit-shaped, and the diameter of said first pliable gasket is greater than the length of said slit-shaped opening.

2. The invention as defined in claim 1 wherein said pressure means is an air pump for pumping air into said container.

3. The invention as defined in claim 1 wherein said pressure means is a gas cartridge which may be actuated to force a gas under pressure into said container.

4. The dispenser of claim 1 wherein said container is filled to a predetermined liquid level, said air inlet opens into said container above said liquid level, and said fluid inlet opens into said container below said liquid level.

5. The dispenser of claim 1 wherein said second sealing means comprises:

a first pliable gasket disposed about said fluid inlet and insertable through said second opening;

a first rigid plate affixed to said fluid inlet adjacent said first gasket, said first plate being insertable through said second opening;

a second pliable gasket disposed about said fluid inlet and slidable thereon;

a second rigid plate slidably disposed on said fluid inlet adjacent said second gasket; and means for pressing said gaskets about said second opening between said second plate and said first plate so as to seal said fluid inlet in said second opening.

6. The dispenser of claim 5 wherein said pressing means for sealing said inlet in said second opening comprises:

a threaded external surface on said fluid inlet and a matingly threaded nut disposed on said fluid inlet so as to tighten said second gasket against said first gasket between said first and second plates about said second opening.

* * * * *